US008973789B2

(12) United States Patent
Smith et al.

(10) Patent No.: US 8,973,789 B2
(45) **Date of Patent: *Mar. 10, 2015**

(54) CLOSURE VALVE ASSEMBLY FOR A CONTAINER

(71) Applicant: DS Smith Plastics Limited, Maidenhead (GB)

(72) Inventors: Mark Smith, Plainfield, IL (US); Carsten Pfromm, Glen Ellyn, IL (US)

(73) Assignee: DS Smith Plastics Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/230,175

(22) Filed: Mar. 31, 2014

(65) Prior Publication Data

US 2014/0209643 A1 Jul. 31, 2014

Related U.S. Application Data

(63) Continuation of application No. 13/744,130, filed on Jan. 17, 2013, now Pat. No. 8,820,591, which is a continuation of application No. 12/850,811, filed on Aug. 5, 2010, now Pat. No. 8,397,958.

(51) Int. Cl.

| | |
|---|---|
| ***B65D 5/72*** | (2006.01) |
| ***B65D 51/00*** | (2006.01) |
| ***B65D 47/20*** | (2006.01) |
| ***B65D 75/58*** | (2006.01) |
| ***B67D 7/06*** | (2010.01) |

(52) U.S. Cl.

CPC ..... *B65D 51/002* (2013.01); *B65D 47/2031* (2013.01); *B65D 75/5877* (2013.01); *B67D 7/06* (2013.01)

USPC ..... 222/494; 222/83; 222/89; 222/105; 222/546; 383/202

(58) Field of Classification Search

CPC ..... B65D 47/2031; B65D 51/002; B65D 75/5877; B65D 7/06; B65D 47/2018; B65D 47/2037; B65D 47/38

USPC ..... 141/329, 330; 215/247, 297, 354; 222/80, 81, 83, 83.5, 89, 90, 105, 222/490–494, 544, 546, 562, 563; 383/80, 383/96, 202; 220/265, 266, 267, 277, 378

See application file for complete search history.

(56) References Cited

U.S. PATENT DOCUMENTS

| | | | |
|---|---|---|---|
| 2,576,322 | A | 11/1951 | Waters et al. |
| 2,778,171 | A | 1/1957 | Taunton |
| 2,778,173 | A | 1/1957 | Taunton |
| 2,870,954 | A | 1/1959 | Kulesza |

(Continued)

FOREIGN PATENT DOCUMENTS

| | | |
|---|---|---|
| WO | WO9532129 | 11/1995 |
| WO | WO2004002840 | 1/2004 |

(Continued)

*Primary Examiner* — Patrick M Buechner

(74) *Attorney, Agent, or Firm* — Joseph A. Fuchs; Nixon Peabody LLP

(57) ABSTRACT

A closure assembly for a container having a housing with a fluid passage, a retaining ring attached to an inner surface of a wall of the housing and having a sloping centering flange, and a valve positioned in the housing and sealing the fluid passage.

16 Claims, 5 Drawing Sheets

(56) References Cited

U.S. PATENT DOCUMENTS

| | | | |
|---|---|---|---|
| 2,951,628 | A | 9/1960 | Grussen |
| 3,106,321 | A | 10/1963 | Gorman |
| 3,206,105 | A | 9/1965 | Smith |
| RE3,492 | E | 6/1969 | Greely |
| 3,642,189 | A | 2/1972 | Widenback |
| 3,930,286 | A | 1/1976 | McGowen |
| 3,980,226 | A | 9/1976 | Franz |
| 4,022,258 | A | 5/1977 | Steidley |
| 4,216,899 | A | 8/1980 | Kamp |
| D278,974 | S | 5/1985 | Ray |
| RE32,354 | E | 2/1987 | Savage |
| 4,702,376 | A | 10/1987 | Pagliaro |
| 4,756,422 | A | 7/1988 | Kristen |
| 4,846,587 | A | 7/1989 | Hull |
| 4,941,310 | A | 7/1990 | Kristen |
| 4,953,708 | A | 9/1990 | Beer et al. |
| D316,970 | S | 5/1991 | Dawson et al. |
| D325,521 | S | 4/1992 | Fisher et al. |
| 5,115,950 | A | 5/1992 | Rohr |
| 5,174,657 | A | 12/1992 | Peppiatt |
| 5,180,191 | A | 1/1993 | Biba |
| 5,213,236 | A | 5/1993 | Brown et al. |
| 5,219,229 | A | 6/1993 | Sengewald |
| 5,228,271 | A | 7/1993 | Wallace |
| 5,271,531 | A | 12/1993 | Rohr et al. |
| 5,322,450 | A | 6/1994 | Willing |
| 5,332,095 | A | 7/1994 | Wu |
| 5,338,117 | A | 8/1994 | Kucksdorf et al. |
| 5,377,877 | A | 1/1995 | Brown et al. |
| 5,409,144 | A | 4/1995 | Brown |
| 5,439,143 | A | 8/1995 | Brown |
| 5,450,963 | A | 9/1995 | Carson |
| 5,480,030 | A | 1/1996 | Sweeney et al. |
| 5,544,752 | A | 8/1996 | Cox |
| 5,722,773 | A | 3/1998 | Conrad |
| 5,765,608 | A | 6/1998 | Kristen |
| 5,839,614 | A | 11/1998 | Brown |
| 5,842,618 | A | 12/1998 | Julemont et al. |
| 5,843,540 | A | 12/1998 | Heydarpour et al. |
| 5,881,881 | A | 3/1999 | Carrington |
| 5,934,512 | A | 8/1999 | Lampe et al. |
| 5,938,086 | A | 8/1999 | Gross |
| 5,954,237 | A | 9/1999 | Lampe et al. |
| 5,996,800 | A | 12/1999 | Pratt |
| 6,021,624 | A | 2/2000 | Richison et al. |
| 6,033,113 | A | 3/2000 | Anderson |
| 6,039,182 | A | 3/2000 | Light |
| 6,059,457 | A | 5/2000 | Sprehe et al. |
| 6,070,397 | A | 6/2000 | Bachhuber |
| 6,079,594 | A | 6/2000 | Brown et al. |
| 6,230,940 | B1 | 5/2001 | Manning et al. |
| 6,273,296 | B1 | 8/2001 | Brown |
| 6,279,783 | B1 | 8/2001 | Brown |
| 6,293,437 | B1 | 9/2001 | Socier et al. |
| 6,357,915 | B2 | 3/2002 | Anderson |
| 6,405,901 | B1 | 6/2002 | Schantz et al. |
| 6,427,874 | B2 | 8/2002 | Brown |
| 6,446,844 | B1 | 9/2002 | Gross |
| 6,464,394 | B1 | 10/2002 | Galomb |
| 6,530,504 | B2 | 3/2003 | Socier |
| 6,581,641 | B2 | 6/2003 | Skeens et al. |
| 6,595,391 | B1 | 7/2003 | Anderson |
| 6,604,634 | B2 | 8/2003 | Su |
| 6,607,097 | B2 | 8/2003 | Savage et al. |
| 6,616,016 | B2 | 9/2003 | Hicks et al. |
| 6,634,384 | B2 | 10/2003 | Skeens et al. |
| 6,672,479 | B2 | 1/2004 | Shiraishi et al. |
| 6,675,191 | B1 | 1/2004 | Ito |
| 6,679,375 | B1 | 1/2004 | Coory |
| 6,715,644 | B2 | 4/2004 | Wilford |
| 6,729,473 | B2 | 5/2004 | Anderson |
| 6,749,092 | B2 | 6/2004 | Olechowski et al. |
| 6,799,680 | B2 | 10/2004 | Mak |
| D501,134 | S | 1/2005 | Takahashi et al. |
| 6,846,107 | B2 | 1/2005 | Anderson et al. |
| 6,851,579 | B2 | 2/2005 | Savage et al. |
| 6,854,887 | B2 | 2/2005 | Anderson |
| 6,932,509 | B2 | 8/2005 | Shah et al. |
| 6,957,915 | B2 | 10/2005 | Tankersley |
| 6,983,845 | B2 | 1/2006 | Shah et al. |
| 6,984,278 | B2 | 1/2006 | Anderson |
| 7,004,632 | B2 | 2/2006 | Hamilton |
| 7,014,363 | B2 | 3/2006 | Hanson |
| 7,022,058 | B2 | 4/2006 | Lee et al. |
| 7,040,810 | B2 | 5/2006 | Steele |
| 7,055,720 | B1 | 6/2006 | Pritchard |
| 7,087,130 | B2 | 8/2006 | Wu et al. |
| 7,138,025 | B2 | 11/2006 | Wu et al. |
| RE39,520 | E | 3/2007 | Hess et al. |
| 7,210,848 | B2 | 5/2007 | Barbier et |
| 7,290,060 | B2 | 10/2007 | Kong et al. |
| 7,357,277 | B2 | 4/2008 | Verespej et al. |
| 7,387,220 | B2 | 6/2008 | Verespej et al. |
| 7,398,953 | B2 | 7/2008 | Anderson |
| 7,422,369 | B2 | 9/2008 | Bergman et al. |
| 7,438,473 | B2 | 10/2008 | Borchardt et al. |
| D579,770 | S | 11/2008 | Pedersen et al. |
| D582,788 | S | 12/2008 | Smith |
| 7,552,907 | B2 | 6/2009 | Anderson |
| 7,578,320 | B2 | 8/2009 | Borchardt et al. |
| 7,597,479 | B2 | 10/2009 | Zimmerman et al. |
| 7,607,555 | B2 | 10/2009 | Smith |
| 7,614,430 | B2 | 11/2009 | Bergman et al. |
| D608,656 | S | 1/2010 | Wilkes et al. |
| 7,651,579 | B1 | 1/2010 | Reuhs et al. |
| 7,726,880 | B2 | 6/2010 | Zimmerman et al. |
| D621,280 | S | 8/2010 | Steele |
| 7,784,652 | B2 | 8/2010 | Gaus et al. |
| 7,798,714 | B2 | 9/2010 | Zimmerman et al. |
| 7,857,155 | B2 | 12/2010 | Roberts et al. |
| 7,861,393 | B2 | 1/2011 | Pugne |
| 7,942,578 | B2 | 5/2011 | Andersen |
| 7,972,064 | B2 | 7/2011 | Anderson |
| 7,980,424 | B2 | 7/2011 | Johnson |
| 7,980,430 | B2 | 7/2011 | Hickok et al. |
| 8,286,839 | B2 | 10/2012 | Jasper |
| 8,397,958 | B2 | 3/2013 | Smith et al. |
| 2002/0076471 | A1 | 6/2002 | Olsson |
| 2002/0102032 | A1 | 8/2002 | Sturgis et al. |
| 2002/0130139 | A1 | 9/2002 | Shiraishi et al. |
| 2003/0024847 | A1 | 2/2003 | Malaspina |
| 2003/0059130 | A1 | 3/2003 | Yoneyama et al. |
| 2003/0102245 | A1 | 6/2003 | Wang |
| 2004/0000503 | A1 | 1/2004 | Shah et al. |
| 2004/0007494 | A1 | 1/2004 | Popeil et al. |
| 2004/0040987 | A1 | 3/2004 | Ramsey et al. |
| 2004/0050745 | A1 | 3/2004 | Lee et al. |
| 2004/0091179 | A1 | 5/2004 | Anderson |
| 2004/0178220 | A1 | 9/2004 | Smith |
| 2004/0188310 | A1 | 9/2004 | Hamilton et al. |
| 2004/0232175 | A1 | 11/2004 | deCler et al. |
| 2005/0025396 | A1 | 2/2005 | Erkembrack |
| 2005/0029704 | A1 | 2/2005 | Wu et al. |
| 2005/0034806 | A1 | 2/2005 | Wu et al. |
| 2005/0034807 | A1 | 2/2005 | Wu et al. |
| 2005/0035020 | A1 | 2/2005 | Wu et al. |
| 2005/0036519 | A1 | 2/2005 | Balakrishnan et al. |
| 2005/0036717 | A1 | 2/2005 | Wu et al. |
| 2005/0036718 | A1 | 2/2005 | Wu et al. |
| 2005/0037163 | A1 | 2/2005 | Wu et al. |
| 2005/0037164 | A1 | 2/2005 | Wu et al. |
| 2005/0043158 | A1 | 2/2005 | Wu et al. |
| 2005/0063620 | A1 | 3/2005 | Anderson |
| 2005/0065007 | A1 | 3/2005 | Wu et al. |
| 2005/0070412 | A1 | 3/2005 | Wu et al. |
| 2005/0143243 | A1 | 6/2005 | Lee et al. |
| 2005/0147330 | A1 | 7/2005 | Lee et al. |
| 2005/0147774 | A1 | 7/2005 | Lee et al. |
| 2005/0172577 | A1 | 8/2005 | Oltrogge |
| 2005/0205455 | A1 | 9/2005 | Harrison |
| 2005/0220373 | A1 | 10/2005 | Wu et al. |
| 2005/0269354 | A1 | 12/2005 | Smith |
| 2005/0286808 | A1 | 12/2005 | Zimmerman et al. |
| 2006/0035046 | A1 | 2/2006 | Lee et al. |

(56) References Cited

U.S. PATENT DOCUMENTS

| | | | |
|---|---|---|---|
| 2006/0048483 | A1 | 3/2006 | Tilman et al. |
| 2006/0053749 | A1 | 3/2006 | Scanian |
| 2006/0110079 | A1 | 5/2006 | Zimmerman et al. |
| 2006/0131328 | A1 | 6/2006 | Anderson |
| 2006/0157140 | A1 | 7/2006 | Bergman et al. |
| 2006/0159576 | A1 | 7/2006 | Bergman et al. |
| 2006/0182371 | A1 | 8/2006 | Borchardt et al. |
| 2006/0193540 | A1 | 8/2006 | Borchardt et al. |
| 2006/0215942 | A1 | 9/2006 | Steele |
| 2006/0280388 | A1 | 12/2006 | Zimmerman et al. |
| 2006/0280389 | A1 | 12/2006 | Zimmerman et al. |
| 2006/0283148 | A1 | 12/2006 | Zimmerman et al. |
| 2007/0036471 | A1 | 2/2007 | Anasis et al. |
| 2007/0092167 | A1 | 4/2007 | Tilman et al. |
| 2007/0101682 | A1 | 5/2007 | Tilman et al. |
| 2007/0101685 | A1 | 5/2007 | Tilman et al. |
| 2007/0138123 | A1 | 6/2007 | Blomdahl et al. |
| 2007/0154118 | A1 | 7/2007 | Tilman et al. |
| 2007/0205216 | A1 | 9/2007 | Smith |
| 2007/0284397 | A1 | 12/2007 | Hickok et al. |
| 2007/0286534 | A1 | 12/2007 | Tilman et al. |
| 2007/0295765 | A1 | 12/2007 | Bull et al. |
| 2008/0028730 | A1 | 2/2008 | Savicki et al. |
| 2008/0044113 | A1 | 2/2008 | Tilman et al. |
| 2008/0138459 | A1 | 6/2008 | Gaikwad et al. |
| 2008/0189913 | A1 | 8/2008 | Bergman et al. |
| 2008/0190512 | A1 | 8/2008 | Borchardt et al. |
| 2008/0226200 | A1 | 9/2008 | Murray |
| 2008/0237271 | A1 | 10/2008 | Olechowski |
| 2008/0237278 | A1 | 10/2008 | Gaus et al. |
| 2008/0240626 | A1 | 10/2008 | Bell |
| 2008/0256901 | A1 | 10/2008 | Custer et al. |
| 2008/0289719 | A1 | 11/2008 | Bergman et al. |
| 2009/0000253 | A1 | 1/2009 | Borchardt et al. |
| 2009/0007803 | A1 | 1/2009 | Bergman et al. |
| 2009/0173038 | A1 | 7/2009 | Savicki et al. |
| 2009/0188950 | A1 | 7/2009 | Gaus et al. |
| 2009/0212078 | A1 | 8/2009 | Gaus |
| 2009/0229225 | A1 | 9/2009 | Borchardt et al. |
| 2009/0238495 | A1 | 9/2009 | Anderson |
| 2009/0242589 | A1 | 10/2009 | Berthelin et al. |
| 2010/0054633 | A1 | 3/2010 | Chang |
| 2010/0116371 | A1 | 5/2010 | Gaus |
| 2010/0133273 | A1 | 6/2010 | Thurman et al. |
| 2010/0172600 | A1 | 7/2010 | Sherrill et al. |
| 2010/0177990 | A1 | 7/2010 | Neltner et al. |
| 2010/0180548 | A1 | 7/2010 | Binger et al. |
| 2010/0183251 | A1 | 7/2010 | Neltner et al. |
| 2010/0193516 | A1 | 8/2010 | LaBean et al. |
| 2010/0200588 | A1 | 8/2010 | Bergman et al. |
| 2010/0205909 | A1 | 8/2010 | Zimmerman et al. |
| 2010/0218461 | A1 | 9/2010 | Borchardt et al. |
| 2010/0237070 | A1 | 9/2010 | Coonce et al. |
| 2011/0019937 | A1 | 1/2011 | Steinwagner et al. |
| 2011/0069908 | A1 | 3/2011 | Wilkes et al. |
| 2012/0111902 | A1 | 5/2012 | Delamare et al. |
| 2012/0187158 | A1 | 7/2012 | Pritchard |

FOREIGN PATENT DOCUMENTS

| | | |
|---|---|---|
| WO | WO2004002841 | 1/2004 |
| WO | WO2004002850 | 1/2004 |
| WO | WO2005000706 | 1/2005 |
| WO | WO2005016774 | 2/2005 |
| WO | WO2005040005 | 5/2005 |

CLOSURE VALVE ASSEMBLY FOR A CONTAINER

RELATED APPLICATION

This is a continuation of U.S. patent application Ser. No. 13/744,130 filed on Jan. 17, 2013 which is a continuation of U.S. patent application Ser. No. 12/850,811 filed on Aug. 5, 2010, now U.S. Pat. No. 8,397,958, both of which are incorporated in their entirety herein by reference and made a part hereof.

TECHNICAL FIELD

The present invention provides a closure valve assembly for a container and preferably a closure assembly for a flexible food container.

BACKGROUND OF THE INVENTION

Collapsible plastic bags are often used to store liquid products such as chemicals, soft drink syrup, fruit juices, dairy, dairy blends, smoothies and food condiments. The plastic bags are typically housed in a corrugated paperboard box to aid in the transporting, handling and dispensing of the product. Such packaging systems are commonly referred to as "bag-in-box" packaging systems.

The plastic bags typically have sidewalls sealed along a peripheral seam to define a fluid containing chamber. An access member associated with the bag provides fluid communication with the contents of the bag. The access member can be an assembly for connecting the access member to a fluid transfer line that can remove the contained products under vacuum pressure in aseptic or non-aseptic fashion.

SUMMARY OF THE INVENTION

The present invention provides a closure assembly for a container. The assembly has a housing, a retaining ring and a valve. The housing has two coaxially disposed and radially-spaced, generally-cylindrical walls extending axially away from a top wall surface to define an annular chamber therebetween. An inner surface of the second annular wall defines a fluid passage having a fluid inlet and a fluid outlet, a retaining ring receiving surface, and a first valve receiving surface spaced axially inwardly from the retaining ring receiving surface. The retaining ring receiving surface has a first annular protuberance extending radially inwardly from the inner surface into the first fluid passage and a first annular notch spaced axially from the protuberance and extending radially outwardly.

The retaining ring has a peripheral connection portion disposed about a second fluid passage, the connection portion being in cooperative engagement with the retaining ring receiving surface, the connection portion having an axially outwardly extending annular flange positioned in the first notch. The annular flange has opposed first and second opposed surfaces with a third cylindrical wall extending from the first surface and a fourth cylindrical wall extending from the second surface. The third cylindrical wall has an outer surface abutting an outer surface of the first annular protuberance, and the fourth cylindrical wall having a second valve receiving surface.

The valve is disposed in the fluid passage and seals the fluid passage. The valve has opposed surfaces having a retaining-ring mating surface extending from a first surface and in cooperative engagement with the second valve receiving surface and a housing-mating surface extending from a second surface opposed to the first surface and cooperatively engaging the first valve-receiving surface.

BRIEF DESCRIPTION OF THE DRAWINGS

To understand the present invention, it will now be described by way of example, with reference to the accompanying drawings in which.

DETAILED DESCRIPTION OF THE PREFERRED EMBODIMENT

Figure 1:
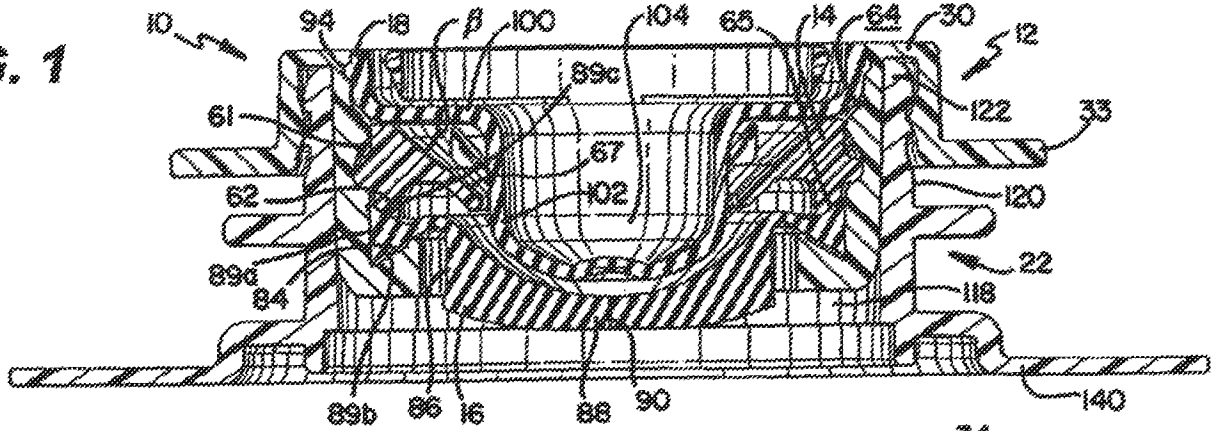
FIG. 1 is a cross-sectional view of one assembly of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 14:
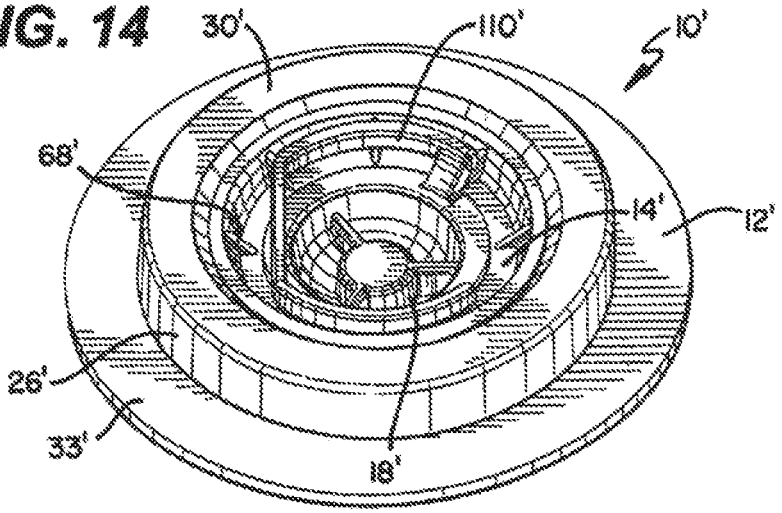
FIG. 14 is a perspective view of a second assembly.
Figure 15:
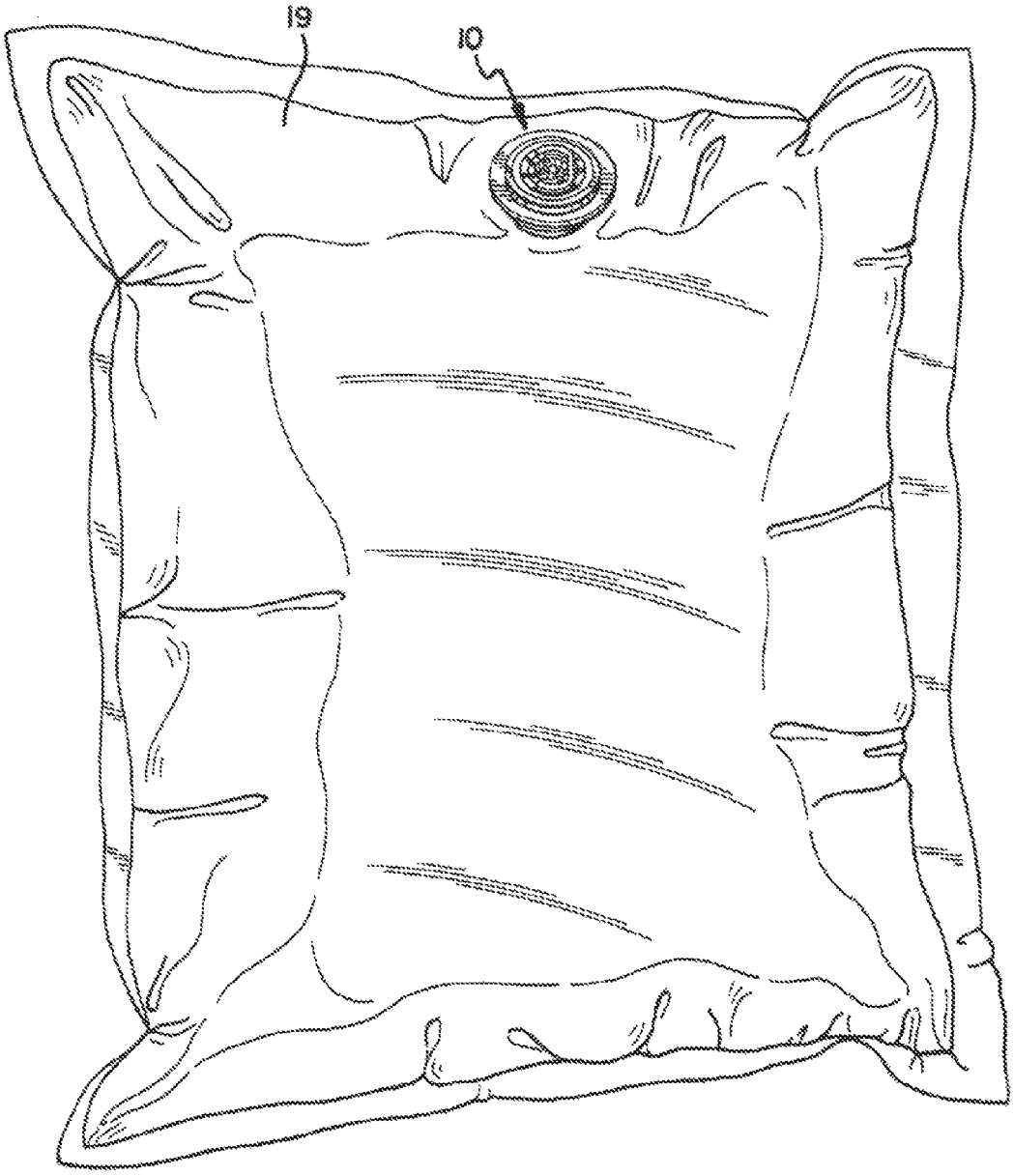
FIG. 15 is a plan view of a flexible container with a valve assembly attached thereto.

FIGS. 1 and 14 show a first and second closure assembly 10, 10' (where like parts are referred to with like numbers with the second assembly using a prime (') designation) having a housing 12, a retaining ring 14, a valve 16, an optional dust cap 18 and an optional fitment 22. The assembly 10 can be attached to a container 19 (FIG. 15) to provide fluid access to the contents of the container. In a preferred form of the invention, the fitment 22 will be attached to the container (FIG. 15) by heat sealing or other method and more preferably, a portion, such as a proximal flange 140 of the fitment, will be positioned within a chamber of the container where it is sealed to an inner surface of a sidewall of the container and a portion, such as a cylindrical wall 120, extends through a hole in the sidewall of the container to outside the sidewall where the sub-assembly of the house 12, the retaining ring 14 and the valve 16 (and optionally the cap 18) are attached to the fitment 22

Figure 2:
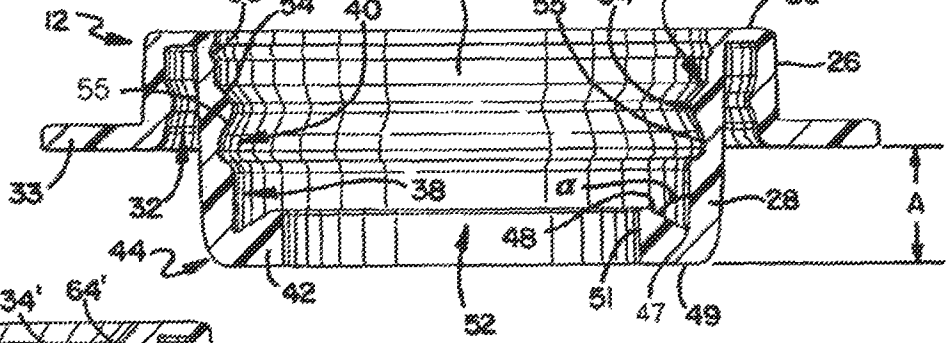
FIG. 2 is a side view in cross-section of a housing.
Figure 3:
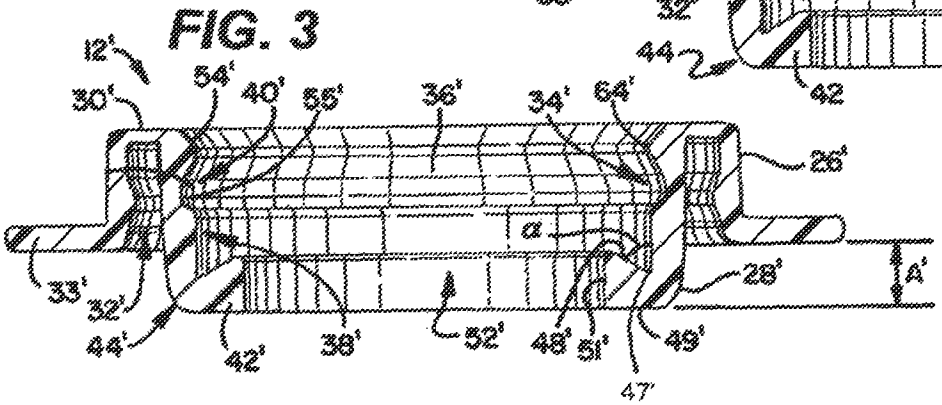
FIG. 3 is a side view in cross-section of a second embodiment of a housing.

FIGS. 2 and 3 show two different embodiments of the housing 12 each having two coaxially disposed and radially-spaced, generally-cylindrical walls 26, 28 extending axially away from a top wall surface 30 to define an annular chamber 32 therebetween. Like numbers will refer to like parts with the exception that the reference numerals of the housing embodiment of FIG. 3 will be designated with a prime character (').

A first of these two walls 26 will sometimes be referred to as the first annular wall 26. A gripping flange 33 extends axially outwardly from a distal end of the first annular wall. Likewise, the second of these two walls 28 will sometimes be referred to as the second annular wall 28. The first annular wall extends a first distance from the top wall surface and the second annular wall extends a second distance from the top wall surface and wherein the second distance is greater than the first distance by an amount indicated with an A. In a preferred form of the invention, the distance A will be from about 0.240 inches to about 0.265 inches and A' will be from about 0.120 inches to about 0.145 inches. An inner surface 34 of the second annular wall defines a fluid passage 36 therethrough and carries a first valve receiving surface 38 and a retaining ring receiving surface 40 spaced axially therefrom.

The first valve receiving surface 38 has a radially inwardly directed flange 42 extending from a distal end 44 of the second annular wall and having an upper surface 48, a lower surface 49 and a blunt inner peripheral edge surface 51 circumjacent a fluid inlet 52 to the fluid passage 36. In a preferred form of the invention, an annular segment of the inner surface proximate the flange 42 forms an angle α with an upper surface 48 of flange 42 to define an annular notch 47. In a preferred form of the invention, a is from about 45° to about 90°. A fifth upstanding wall 84 (FIG. 7) of the valve 16 is compressed into the notch 47 by the second valve receiving surface 65 of the retaining ring 14.

Figure 12:
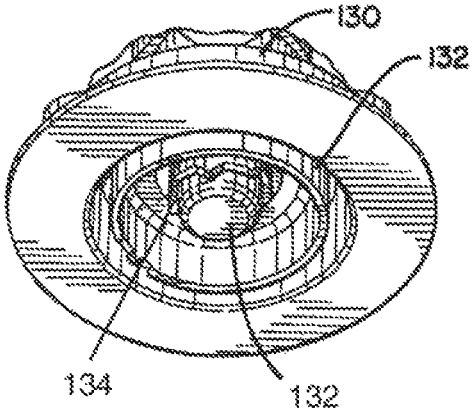
FIG. 12 is a perspective view of a housing docked to a fluid dispensing apparatus.
Figure 13:
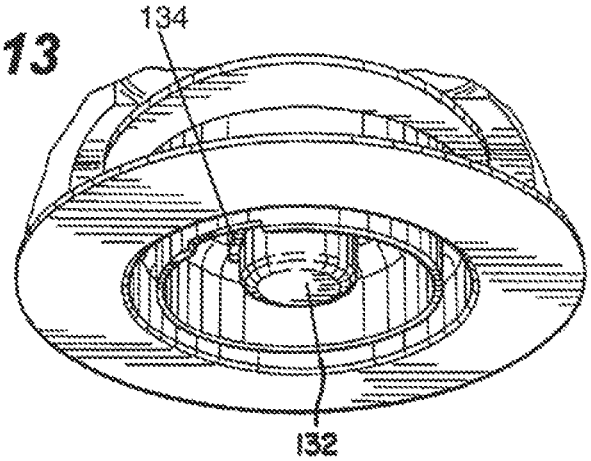
FIG. 13 is a perspective view of a housing docked to a fluid dispensing apparatus.

The radially inwardly directed forces applied to the valve by the cooperative engagement of the retaining ring and the housing assists in retaining the valve in its proper location during engagement of the assembly with a fluid access member that pierces the valve with a tube and places axially inwardly directed forces as shown in FIGS. 12 and 13.

The retaining-ring receiving surface 40 is spaced axially from the valve receiving surface and has a protuberance 54 and a detent 55 that are dimensioned to receive a peripheral edge of the retaining ring 14.

Figure 4:
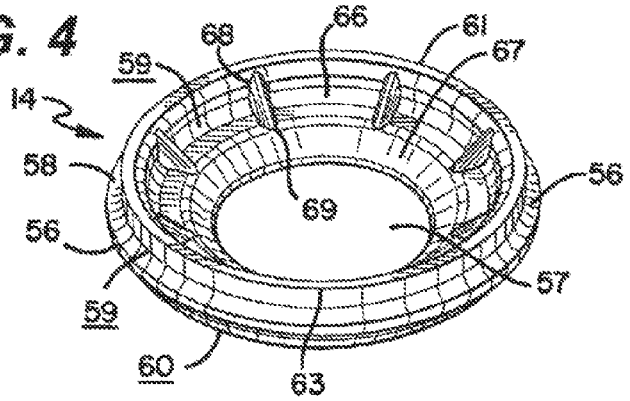
FIG. 4 is a perspective view of a retaining ring.
Figure 5:
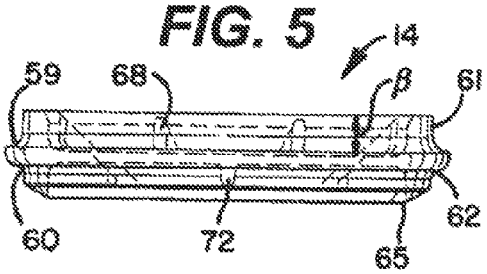
FIG. 5 is a side view of the retaining ring of FIG. 4.
Figure 6:
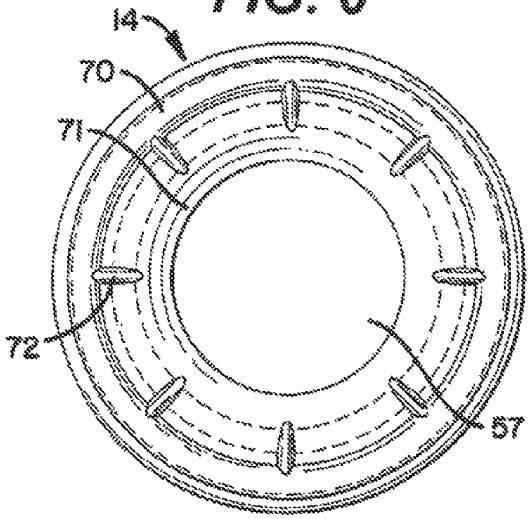
FIG. 6 is a bottom view of the retaining ring of FIG. 4.

FIGS. 4-6 show the retaining ring 14 having a peripheral connection portion 56 disposed about a second fluid passage 57, the connection portion being in cooperative engagement with the retaining ring receiving surface 40. The connection portion 56 has an axially outwardly extending annular flange 58 positioned in the detent 55 and having first and second opposed surfaces 59, 60 with a third cylindrical wall 61 extending axially from the first surface 59 and a fourth cylindrical wall 62 extending axially from the second surface 60. The third cylindrical wall 61 has an outer surface 63 abutting an outer surface 64 of the first annular protuberance 54. The fourth cylindrical wall has a second valve receiving surface 65.

FIGS. 4-5 show the first surface of the ring 59 is segmented having a first annular portion 66 proximate the third cylindrical wall 61 and a second annular portion 67 spaced radially inwardly from the first annular portion 66. The first annular portion 66 has a generally horizontal surface forming approximately a right angle with the third cylindrical wall. The second annular portion 67 has an axially inwardly tapering surface from radially outwardly to radially inwardly to define an angle β between a surface of the third cylindrical wall 61 and the second annular portion 67. In a preferred form of the invention, the angle β will be about 90° to about 120°. The tapered wall assists in docking and centering of a suction tube within the fluid passage 36 of the housing.

A plurality of triangular shaped tabs 68 are circumferentially spaced along the first annular portion 66. In a preferred form of the invention the tabs 68 are evenly spaced and there are from four to twelve tabs and more preferably eight tabs. The tabs 68 are generally in the shape of a right triangle and, in a preferred form of the invention, each of the tabs have its most radially inward vertex 69 positioned at the junction between the first and second annular portions 66, 67 and does not extend on to a surface of the second annular portion 67.

FIG. 6 shows the second surface 60 of the ring having complementary third and fourth annular portions 70, 71 corresponding respectively to the first and second annular portions 66, 67. The second surface 60 has a plurality of generally rectangular shaped protuberances 72 extending from the fourth cylindrical wall 62 with each terminating in the fourth annular portion 71 proximate the second fluid passage 57. In a preferred form of the invention, the protuberances 72 are positioned in line with gaps between adjacent tabs 68 on the first surface 59.

Figure 7:
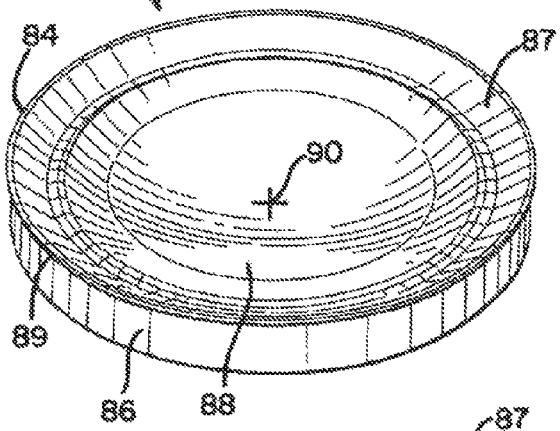
FIG. 7 is a perspective view of a valve.
Figure 8:
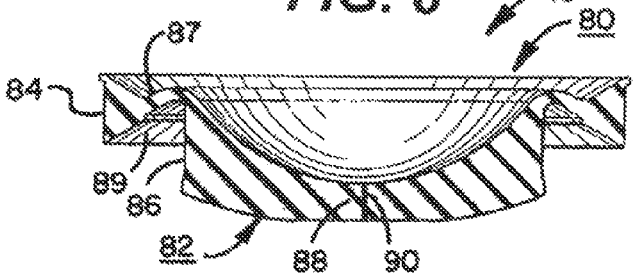
FIG. 8 is a side elevation view of the valve of FIG. 7.
Figure 9:
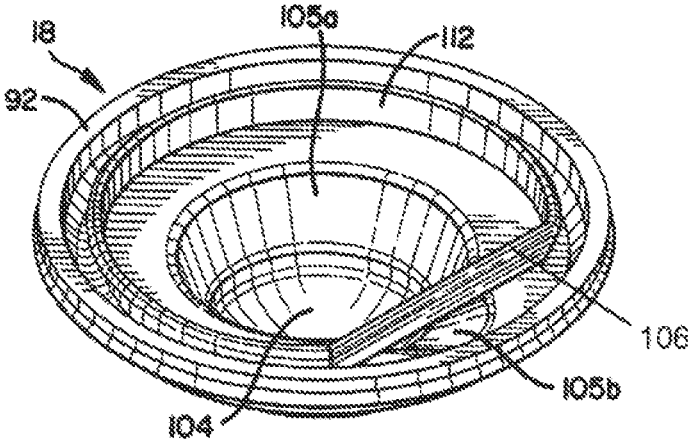
FIG. 9 is a perspective view of a cap.
Figure 10:
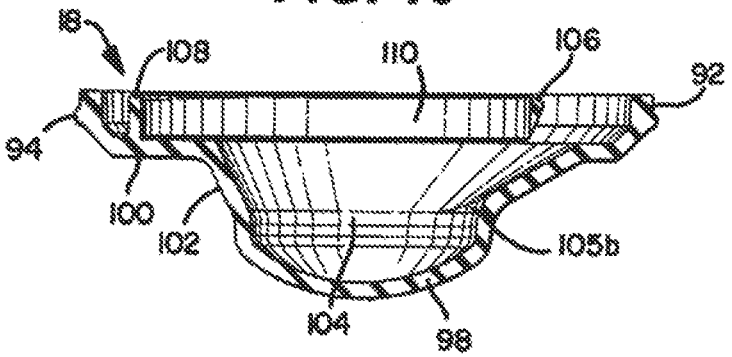
FIG. 10 is a side elevation view of the cap of FIG. 9.
Figure 11:
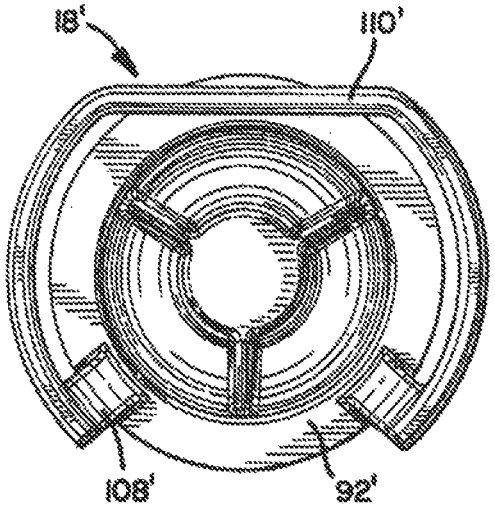
FIG. 11 is a plan view of a second embodiment of a cap.

FIG. 1 shows the valve 16 is disposed in the fluid passage 36 and seals it from ingress or egress of fluids through the assembly. FIGS. 1, 7 and 8 show the valve 16 has opposed first and second surfaces 80, 82 and a fifth and a sixth generally cylindrical wall 84, 86, a retaining-ring mating surface 87 and a generally arrow-head shaped housing-mating surface 89 having transversely disposed legs 89*a,b,c* with legs 89*a,b* abutting the first valve-receiving surface 38 and leg 89*c* abutting the second valve-receiving surface 65 of the retaining ring. A bottom wall 88 seals an end of the sixth cylindrical wall. In a preferred form of the invention, the bottom wall 88 will be capable of moving between open (FIGS. 12 and 13) and closed positions (FIG. 1). In one preferred form of the invention, the wall will have a puncture site 90 where the valve has reduced resistance to piercing which can be achieved by, for example, having a reduced thickness portion or score lines extending through a partial or full thickness of the valve. In a preferred form of the invention, the puncture site will be centrally disposed. Also, in a preferred form of the invention, the bottom wall 88 will be domed axially outwardly.

FIGS. 1, 9-11 and 14 show two embodiments of a cap 18 that can be used to releasably attach to the housing 12 to provide protection from contamination and damage. The cap 18 has a peripheral, upstanding wall 92 having an annular protuberance 94 extending from an outer surface of the wall 92 and is dimensioned to lock within an annular detent 96 on the inner surface 34 of the housing 12. A bottom wall 98 of the cap extends radially inwardly from the peripheral wall 92 through a transition region 100 then to an axially downwardly extending section 102 to define a chamber 104. In one preferred form of the invention, the chamber 104 will have a first and second intersecting circular portions 105*a,b* (FIG. 9) for access by a finger of a user of the assembly. A pull-ring 106 is provided for a user to remove the cap from the assembly and in one preferred form of the invention, a portion of the pull ring will cross over circular portion 105*b*. The pull-ring 106 has a hinge 108 and an arm 110. The arm 110 forms a loop structure 112 dimensioned to be grasped by a user of the assembly. To access the assembly, the arm 110 is pulled by a user axially outwardly to cause the arm to pivot upward and the cap and can be removed from the assembly by a gentle tug by the user.

FIG. 1 shows the fitment 22 having a cylindrical wall 120 having an upper peripheral end surface 122 for docking within the annular chamber 32 and a proximal flange 140 for sealing to a wall of a container. The fitment 22 defines a fluid passage 118 in fluid communication with a chamber of the container. In a preferred form of the invention, the fitment 22 is attached to a wall of a container and provides fluid access to a chamber of the container. In one preferred form of the invention, the container is a flexible container having sidewalls that are capable of collapsing upon draining of the contents of the container.

In a preferred form of the invention, the housing 12, the retaining ring 14 and the cap 18 are fabricated from polymeric materials and preferably in an injection molding or other thermal forming process. Suitable materials for these parts include homopolymers and copolymers having monomers selected from olefins, amides, esters, ethers, carbonates, and combinations of the same. In one preferred form of the invention, the housing is made from a softer material from the retaining ring. In yet another preferred form of the invention, the housing is fabricated from an ethylene monomer and more preferably is an ethylene and α-olefin copolymer and more preferably an ethylene copolymer having a density of less than or about 0.915 g/cc and includes linear low density polyethylenes and ultra-low density polyethylenes. Also, in a preferred form of the invention, the retaining ring is fabricated from a material that is more rigid than the material of the housing and in another preferred form of the invention the retaining ring is fabricated from a polypropylene homopolymer or a propylene and ethylene copolymer. Using a retaining ring that is more rigid than the housing material allows the retaining ring to bite into the housing to mechanically bond the ring in the housing to form a secure attachment. Suitable material for the valve includes natural and synthetic rubbers and elastomers and preferably, the valve is silicone.

FIGS. 12 and 13 show the assembly 10 docked to a fluid access device 130 having a suction tube 132 extending through the piercing site of the valve to access the contents of the container under vacuum pressure. FIG. 12 shows the suction tube 132 partially inserted through the valve and portions 134 of the valve in the piercing area are displaced axially inwardly and in contact with an outer surface of the suction tube 132. Due to the close proximity of the portions 134 with a distal most end of the suction tube 132, fluid flow from the chamber can be slightly diminished. FIG. 13 shows the suction tube 132 more fully inserted through the valve such that the portions 134 are not proximate the distal end of the suction tube and provide for faster evacuation of the container.

While the specific embodiments have been illustrated and described, numerous modifications come to mind without significantly departing from the spirit of the invention, and the scope of protection is only limited by the scope of the accompanying claims.

We claim:

1. A closure assembly for a container comprising:

a housing having a first annular wall and a second annular wall disposed within the first annular wall defining an annular chamber therebetween, an inner surface of the second annular wall defining a fluid passage, the inner surface of the second annular wall having a retaining ring receiving surface, and a first valve receiving surface spaced axially from the retaining ring receiving surface, the first valve receiving surface comprises a radially inwardly directed flange extending from a distal end of the second annular wall to define a fluid inlet to the fluid passage;

a retaining ring having an opening in fluid communication with the fluid passage and having a body engaging tab positioned along an outer peripheral surface and positioned in the retaining ring receiving surface, an annular surface of the retaining ring extends circumjacent the opening and having an axially inwardly tapering surface from radially outwardly to radially inwardly to define a centering flange, and a second valve receiving surface axially spaced from the centering flange; and a valve disposed in the fluid passage and sealing the fluid passage, the valve having opposed surfaces having a retaining ring mating surface extending from a first surface and in cooperative engagement with the second valve receiving surface and a housing mating surface extending from a second surface opposed to the first surface and cooperatively engaging the first valve receiving surface, the valve having a generally concave piercing area having a portion extending through the fluid inlet and outward from the housing and being adapted to be displaced axially inwardly of the housing.

2. The closure assembly of claim 1 further comprising an annular gripping flange extending radially outwardly from a distal end of the first wall.

3. The closure assembly of claim 1 wherein the housing further comprises a top wall having a top wall surface wherein the first annular wall extends a first distance from the top wall surface and the second annular wall extends a second distance from the top wall surface and wherein the second distance is greater than the first distance.

4. The closure assembly of claim 1 further comprising a fitment receiving surface positioned in the annular chamber.

5. The closure of claim 1 wherein the radially inwardly directed flange has an upper surface that forms an angle from about 45° to about 90° from the inner surface of the fluid passage.

6. The closure of claim 1 wherein the valve has concentrically disposed fifth and sixth generally cylindrical walls connected by the retaining ring receiving surface.

7. The closure of claim 6 wherein the valve has a bottom wall closing an end of the sixth generally-cylindrical wall.

8. The closure of claim 7 wherein the bottom wall has a portion that can be moved from a closed position to an open position where fluid can flow through the fluid passage.

9. The closure of claim 8 wherein the bottom wall has a reduced thickness portion.

10. The closure of claim 9 wherein the reduced thickness portion comprises score lines extending through a partial thickness of the valve.

11. The closure of claim 10 wherein the reduced thickness portion is generally centrally disposed on the bottom wall.

12. The closure assembly of claim 11 further comprising a portion of a fitment positioned within the fitment receiving surface.

13. The closure assembly of claim 1 further comprising a cap positioned in the fluid passage and sealing the fluid inlet.

14. The closure of claim 13 wherein the cap has a pull ring.

15. The closure of claim 1 wherein the centering flange forms an angle with an axis of the opening from about 90° to about 120°.

16. The closure of claim 1 further comprising a cap removably connected to the housing.

* * * * *